US006713931B2

(12) United States Patent
Kamiya et al.

(10) Patent No.: US 6,713,931 B2
(45) Date of Patent: Mar. 30, 2004

(54) CYLINDRICAL COMMUTATOR SECURELY FIXED TO MOLD RESIN

(75) Inventors: Yoshihisa Kamiya, Shizuoka-ken (JP); Hiroyuki Kato, Shizuoka-ken (JP); Yoshiyasu Kogure, Shizuoka-ken (JP); Tsutomu Ishiwata, Tokyo (JP); Gene Larson, Forest Lake, MN (US)

(73) Assignee: Sugiyama Seisakusho Co., Ltd., Tokyo (JP)

( * ) Notice: Subject to any disclaimer, the term of this patent is extended or adjusted under 35 U.S.C. 154(b) by 0 days.

(21) Appl. No.: 10/083,751

(22) Filed: Feb. 25, 2002

(65) Prior Publication Data

US 2002/0130584 A1 Sep. 19, 2002

(30) Foreign Application Priority Data

Mar. 13, 2001 (JP) ..... P2001-070531
Oct. 23, 2001 (JP) ..... P2001-325102

(51) Int. Cl.[7] ..... H01R 39/16; H01R 39/52

(52) U.S. Cl. ..... 310/235; 310/234; 310/136; 310/42; 310/236

(58) Field of Search ..... 310/235, 234, 310/132, 42

(56) References Cited

U.S. PATENT DOCUMENTS 5,204,574 A * 4/1993 Kanno et al. ..... 310/233
6,369,484 B1 * 4/2002 Kageyama et al. ..... 310/233

* cited by examiner

*Primary Examiner*—Karl Tamai
*Assistant Examiner*—Heba Y. Elakssabgi
(74) *Attorney, Agent, or Firm*—Kilpatrick Stockton LLP

(57) ABSTRACT

A cylindrical commutator is provided with a plurality of segments arranged at equal intervals around an axis, each of which is provided with a groove on an inner surface thereof and one or more anchors extending from edges of the groove. The grooves and the anchors are extended over substantially the total length of the segments and respectively have end steps and end edges at ends near the hooks, or the anchors can be formed in pair and the pair of anchors are connected with each other at the ends near the hooks.

2 Claims, 8 Drawing Sheets

CYLINDRICAL COMMUTATOR SECURELY FIXED TO MOLD RESIN

BACKGROUND OF THE INVENTION

1. Field of the Invention

The present invention relates to a cylindrical commutator that is used for a compact motor, and a method of manufacturing the same.

2. Description of the Related Art

A cylindrical commutator that is used for a compact electric motor comprises a plurality of segments having hooks at one side for line connection, which are fixed cylindrically in a mold resin. Folded anchors are fixing the segments to the mold resin are provided at both ends of the segments, and are embedded into the mold resin.

In the above structure, the segments are fixed to the mold resin with the anchors at both ends. A portion near the center in the axial direction of the segments is not engaged with the mold resin. There are some problems such that the portion near the centers of the segments becomes buoyant above the mold resin during a high speed rotation.

U.S. Pat. No. 5,204,574 discloses a cylindrical commutator having anchors also provided at the center portion in the axial direction of the segments. The production process is such; deep grooves and shallow recesses are formed mutually on planar base metal, lands between the grooves and the recesses are prepared by cutting in a V-shape with wedge, thereby to form anchors. As the segments have anchors substantially over their total length, the segments can be connected more certainly in comparison with the case of the said conventional cylindrical commutator.

SUMMARY OF THE INVENTION

The above technique has a drawback in that it is possible to form only very low anchors, as the height of the anchors formed is restricted by the height of the ridge. Further, as the cylindrical shape is formed by bending the base metal having the grooves and the recesses, there arise distortions on the cylindrical surface. This leads to a loss of forming precision.

It is an object of the present invention to provide a cylindrical commutator that can be fixedly held using a mold resin and in a high forming precision.

According to the present invention, a commutator is formed as follows. On the internal surface of a base metal cylinder equipped with the plurality of hooks at one end, cuts are formed in a circumferential direction corresponding to each of a plurality of hooks. The cuts are opened to an internal direction to form projections. The cylinder is set to a molding die, and the prepared projections are embedded into a mold resin. On the external peripheral surface of the mold resin, slits are processed at equal intervals in a circumferential direction, and the hooks and the prepared projections are divided for each segment.

DETAILED DESCRIPTION OF THE PREFERRED EMBODIMENT

Figure 1A:
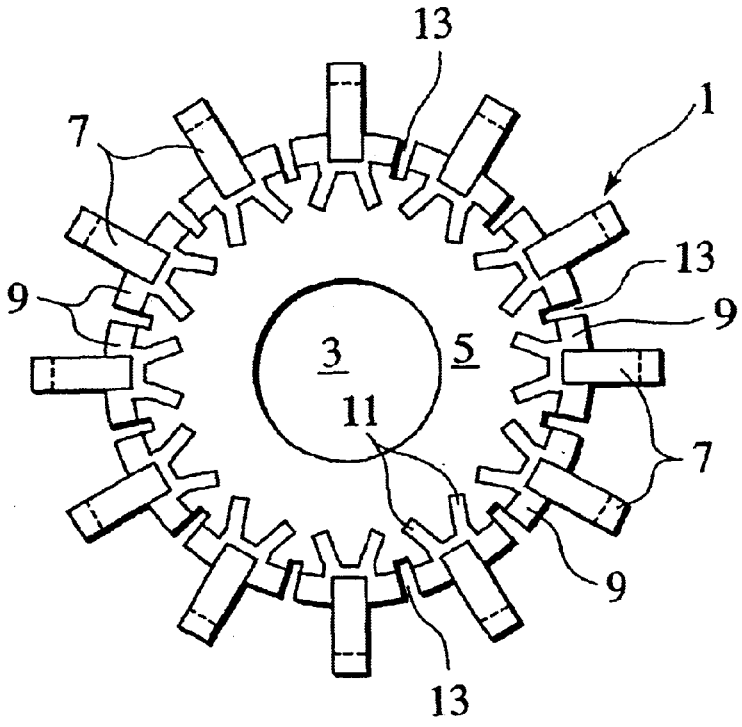
FIG. 1A is a plan view of a cylindrical commutator according to a first embodiment of the present invention.
Figure 1B:
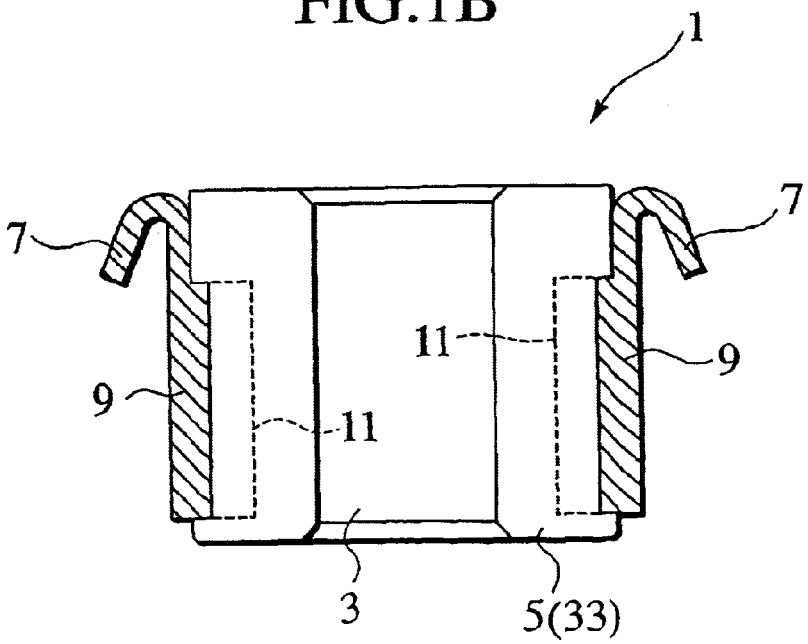
FIG. 1B is a front elevational view of the cylindrical commutator according to the first embodiment of the present invention.

A cylindrical commutator shown in FIGS. 1A and 1B has a cylindrical commutator main body 5 equipped with an engagement hole 3 for engaging a motor shaft on an axial core. The commutator main body 5 consists of a mold resin. On the external peripheral surface of the commutator main body 5, a plurality of segments 9, each having at its one end a hook 7 for connecting with a coil of the motor, are fixedly embedded at equal intervals in a circumferential direction to form a cylindrical shape in total.

Each segment 9 has an anchor 11 over its total length, and the anchor 11 is embedded into the mold resin to be fixedly integrated with the mold resin. The anchors 11 are inclined to a diameter direction of the mold resin. Slits 13 are formed at equal intervals on the external peripheral surface of the mold resin, thereby to divide the segments 9.

Figure 2:
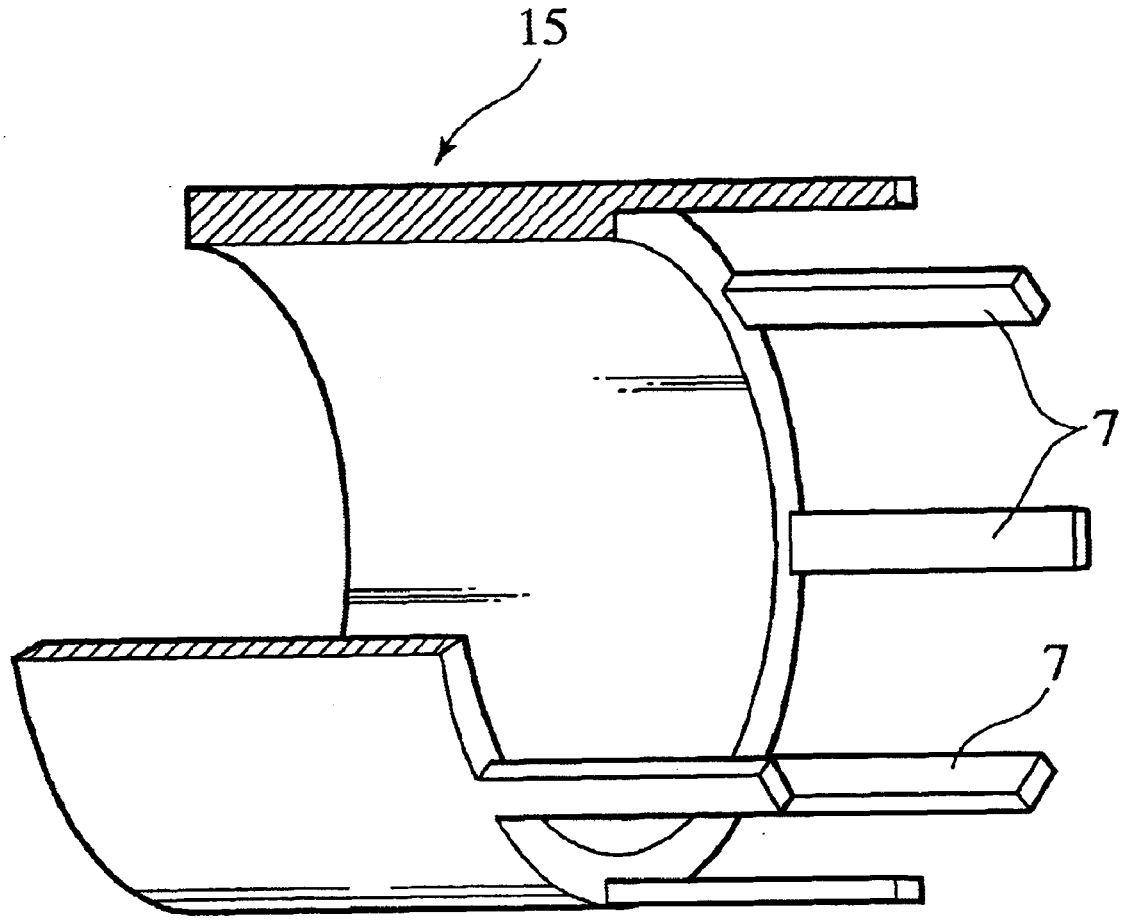
FIG. 2 is a partial sectional view of a commutator base metal before hooks are bent.

Said commutator 1 is manufactured as follows. First, as shown in FIG. 2, a base metal cylinder 15 is prepared that has linear thin projections 7 at equal intervals at its one end, each projection 7 becoming a hook when it is bent. This cylinder 15 is prepared by, for example, first processing a bar-shaped material into a pipe shape, and then forming the projections 7. Alternatively, a pipe material may be suitably cut to form the thin projections 7. Preferably, a metal plate made of copper or copper alloy is pressed to form a thin portion, and this portion is then sheared into a suitable shape and curled, thereby to form a pipe shape having the projections 7 at one end, as shown in FIG. 2.

Figure 11:
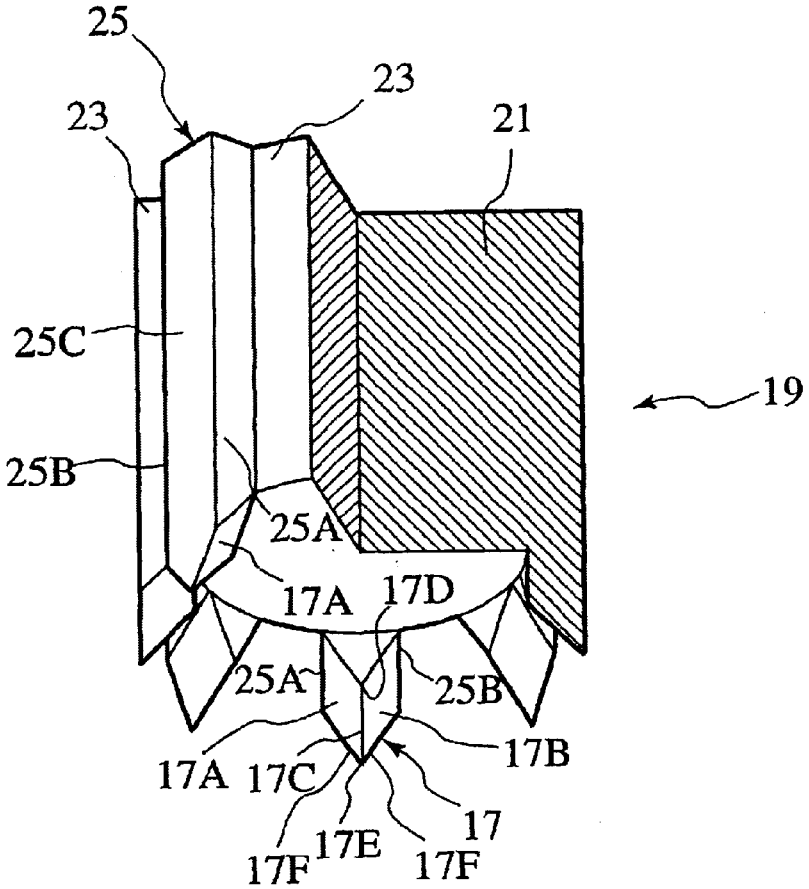
FIG. 11 is a partial sectional view of a cutting tool for preparing anchors.

For preparing the anchors by cutting, a cutting tool 19 having sharp cutting edges at equal intervals in the circumferential direction, as shown in FIG. 11, is used. The cutting tool 19 comprises a plurality of grooves 23 at equal intervals in the circumferential direction on a main body 21 thereof, and further comprises a plurality of bars 25 each having a square cross section integrally protruded at equal intervals in the circumferential direction on a main body 21 thereof. The grooves 23 and the bars 25 are aligned alternatively.

The bars 25 are projected from the one end of the main body 21 of the cutting tool 19 and each tip of the bars 25 is formed angled surfaces 17A and 17B which are connected to side walls 25A and 25B of the bar 25 respectively so as to form a cutting edge 17.

Figure 3A:
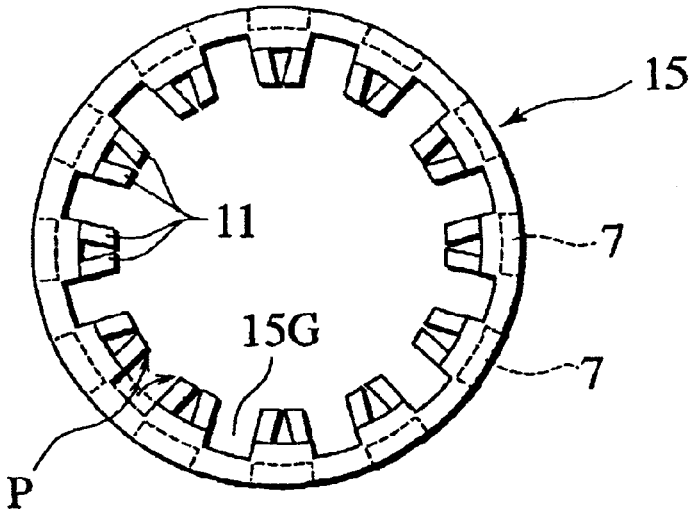
FIG. 3A is a plan view of anchors that are prepared by cutting.

The base metal cylinder 15 is set to a guide mold so that the end portion opposite to the projections 7 is stretched out. The front end 17E of each cutting edge 17 of the cutting tool 19 is brought into contact with an end portion of the cylinder 15. Then, this cutting tool 19 is pressed into the cylinder 15. As a result, as shown in FIG. 3A, the anchors 11 are prepared by cutting at the same time that are arranged at equal intervals in the circumferential direction of the base metal cylinder 15 over substantially the total length of the base metal. As the external portion of the base metal cylinder 15 is protected by the guide mold, the external shape is not deformed by the cutting.

More specifically, the anchors are prepared as follows. The front end of each cutting edge 17 is brought into contact with an intermediate point P of the projection 7 shown in FIG. 3A. When the cutting tool 19 is pressed into the base metal cylinder 15, a part of the internal peripheral surface of the base metal cylinder 15 is cut in a circumferential direction, thereby to form grooves 15G that are parallel with the axial core. When the grooves 15G are formed, the cuttings are formed in the circumferential direction with the cutting edges. Portions positioned inside the groove 15G are each divided into two. As the cutting tool 19 is further pressed into the base metal cylinder 15, panel-shaped projections are formed toward the inside based on the cutting so as to be anchors 11.

When the number of the segments 9 is small, it is possible to increase the size of intervals between the hooks 7 to increase the cutting height (the size in the diameter direction) of the anchors 11. In other words, it is possible to adjust the height of the anchors 11 embedded into the mold resin, corresponding to the number of segments.

Moreover, it has been explained in the above that the portion positioned inside each groove is divided into two for preparing the anchors 11 by cutting with the cutting edge 17. However, it is also possible to prepare the anchors 11 without dividing the portion into two, depending on the shape of the cutting edges 17E. In this case, as compared with the case of dividing the anchors 11 into two, it is possible to prepare the anchors 11 having a larger size of a cutting height.

Figure 3B:
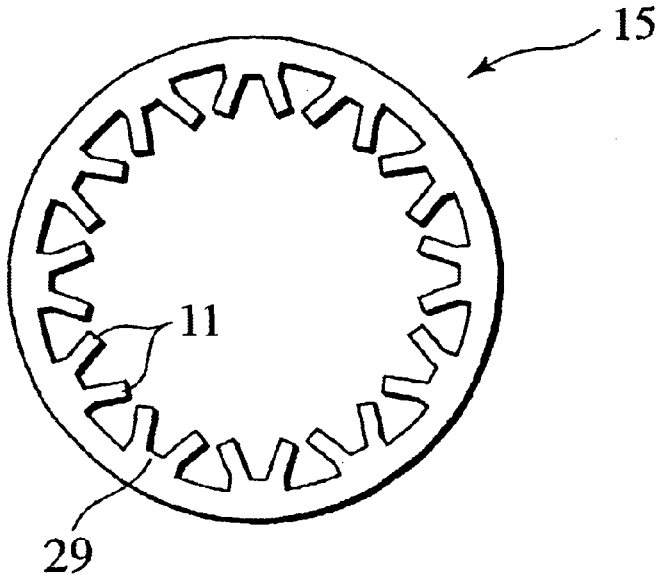
FIG. 3B is a plan view of anchors that can be further spread by an anchor-spreading tool.
Figure 12:
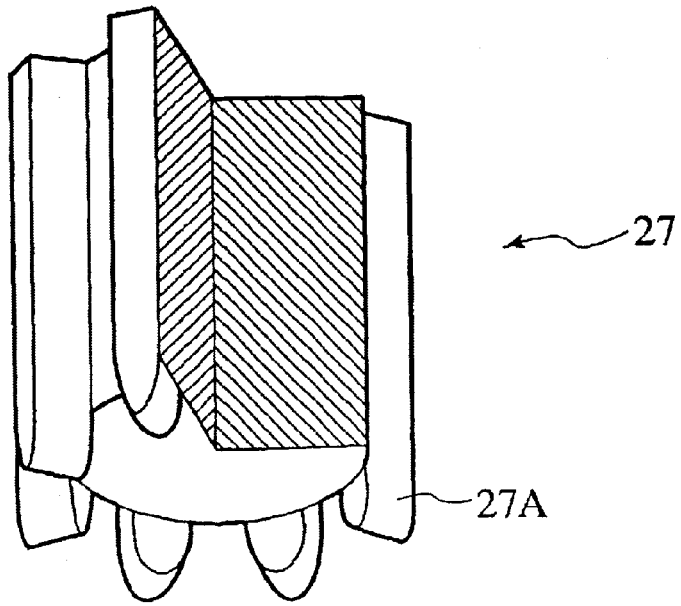
FIG. 12 is a partial sectional view of an anchor-spreading tool for further spreading the anchors.

It is possible to further spread the anchors 11, as shown in FIG. 3B, based on the insertion of an anchor-spreading tool 27 shown in FIG. 12. The anchor-spreading tool 27 has a resembled shape as the cutting tool 19 and equivalent portions as the cutting edges 17E of the cutting tool 19 are formed curved surfaces, which are anchor-spreading portions 27A. The anchor spreading portions 27A are inserted and pressed into between the anchors 11 to widen the intervals between the anchors 11. In this way, it is possible to further widen the interval between each pair of anchors 11.

In this case, a root 29 of a large thickness having a pair of anchors 11 has a dovetail shape in a status that the anchors are prepared by cutting and spreading. In a status that the anchors are embedded into the mold resin, the engagement between the commutator and the mold resin is similar to a dovetail junction. However, according to the present embodiment, the anchors 11 having a larger cutting are provided over substantially the total length. Therefore, as compared with the case where a simple dovetail junction is formed, it is possible to increase the size of the anchors that are embedded into the mold resin. As a result, it is possible to achieve a more secure integration between the mold resin and the segments.

Figure 4:
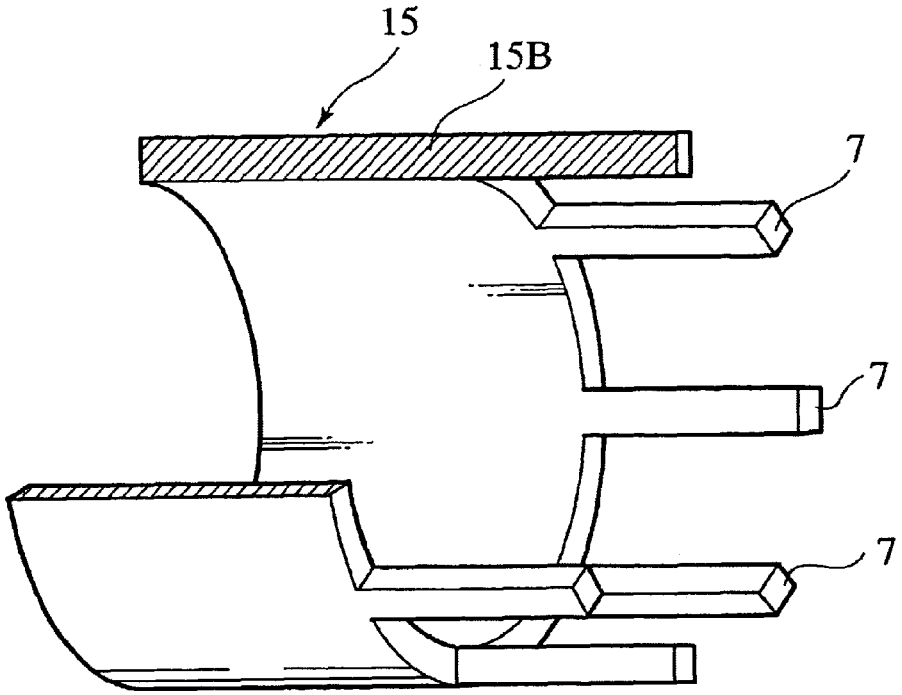
FIG. 4 is a partial sectional view of a commutator base metal according to a modified example of a first embodiment of the present invention.

It has been explained in the above that the thickness of the hooks 7 is smaller than the thickness of the main body portion of the base metal cylinder 15. Alternatively, it is also possible to have such a structure that the thickness of the hooks 7 is equal to the thickness of a main body portion 15B of the cylinder 15 as shown in FIG. 4. In this case, it is also possible to form the anchors 11 by cutting by forming the grooves 15G with the cutting tool over substantially the total length at portions between the hooks 7 on the internal peripheral surface of the cylinder 15, as described above.

Figure 5:
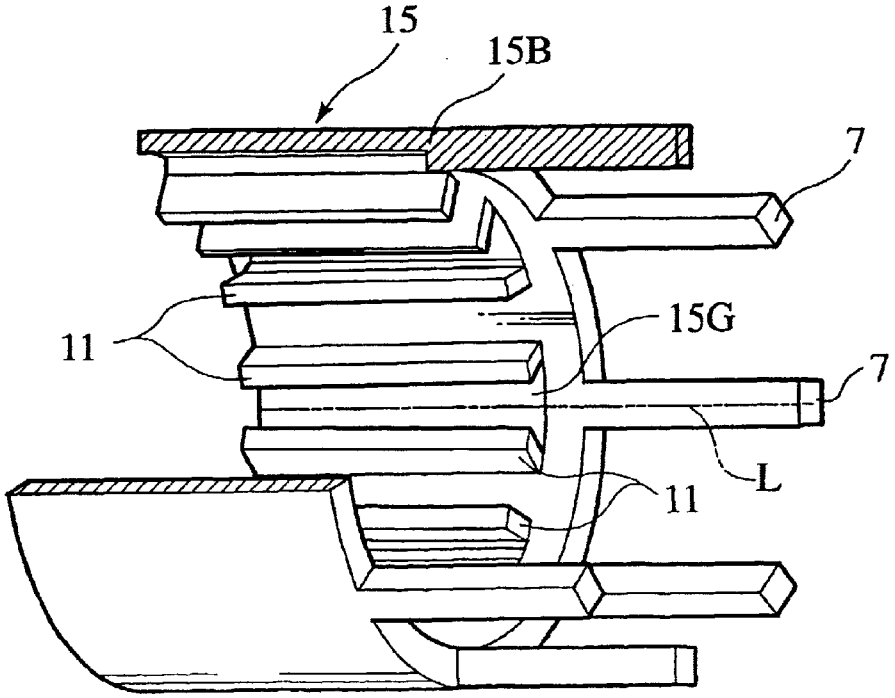
FIG. 5 is a partial sectional view of the commutator base metal shown in FIG. 4 in a status that anchors are prepared by cutting.
Figure 6:
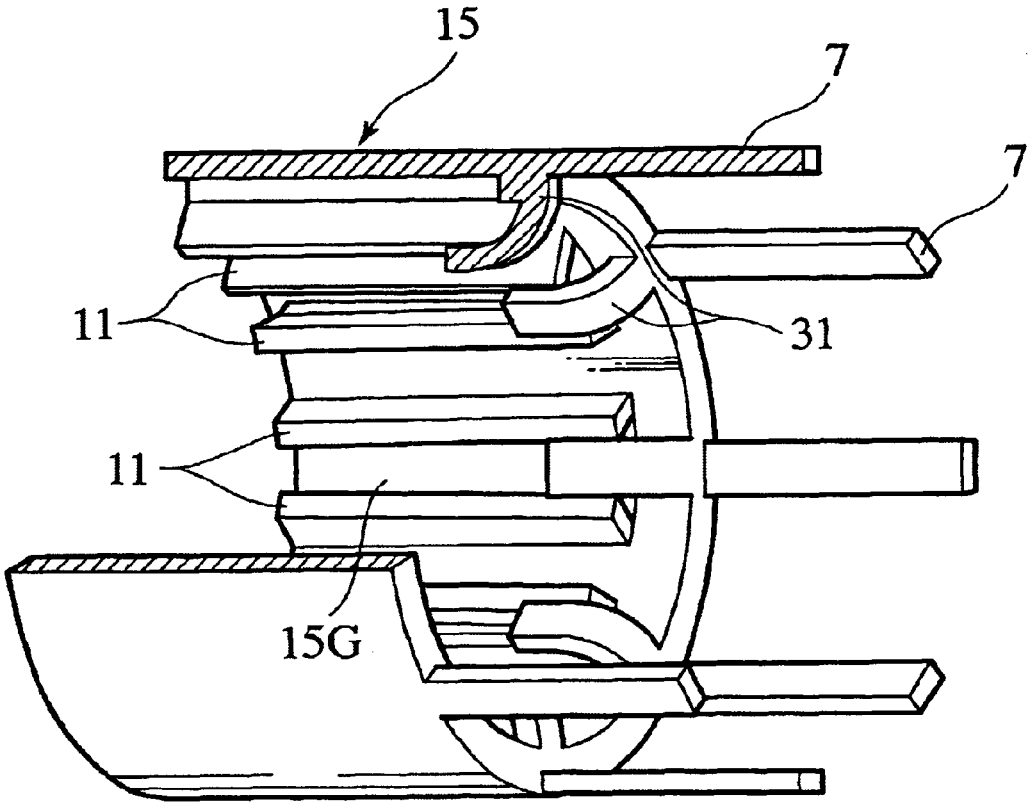
FIG. 6 is a partial sectional view of the commutator base metal shown in FIG. 5 in a status that the thickness of each hook is divided into two, and the internal periphery side of the divided hook is bent to an internal direction.
Figure 7:
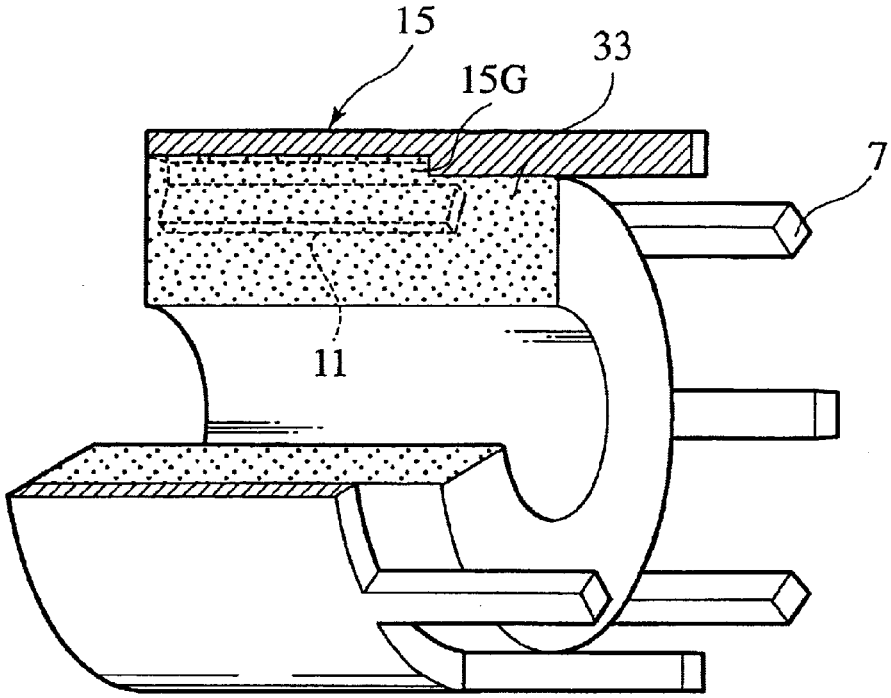
FIG. 7 is a partial sectional view of the commutator base metal in a status that a mold resin is molded inside the base metal, and the mold resin and the commutator base metal are integrated together.
Figure 8:
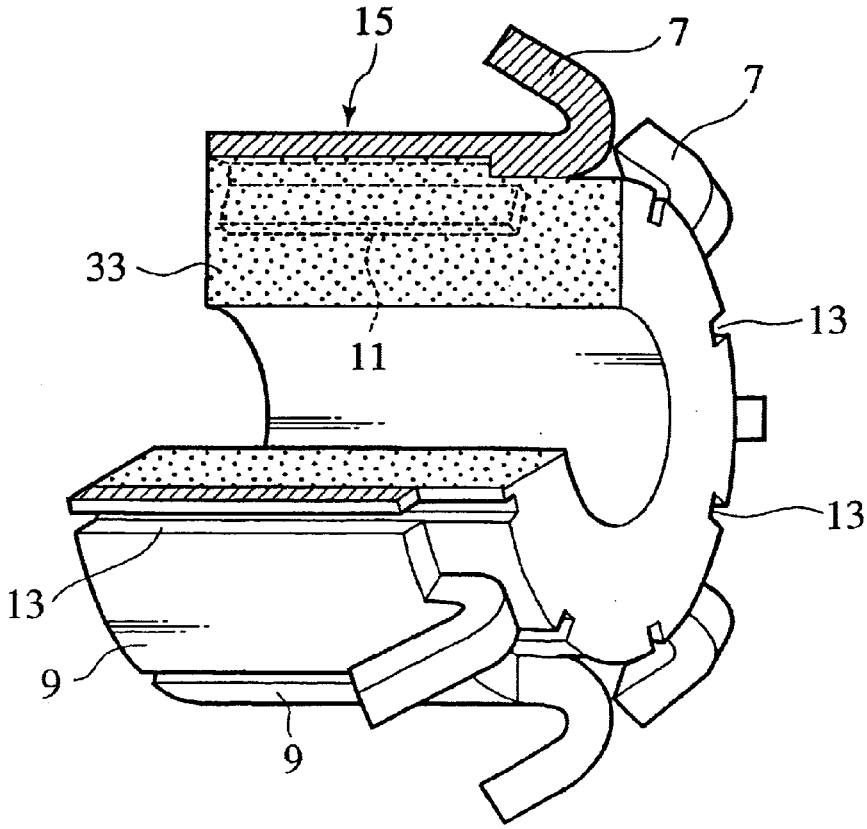
FIG. 8 is a partial sectional view of the mold resin in a status that slits are processed on the external peripheral surface of the mold resin, the slits are divided for each segment, and each hook is bent.

As a preferable modification of the embodiment, it is also possible that the center of the groove 15G formed by the cutting tool and the center of the hook 7 coincide with each other along a line L as shown in FIG. 5. The groove 15G is not formed over substantially the total length of the main body portion 15B of the cylinder 15, but is formed up to a position near the end of the hook 7. Then, as shown in FIG. 6, the thickness of each hook 7 is cut into two, and the inside portion is bent to face the groove 15G to form an anchor 31.

As described above, the thickness of each hook 7 is divided into two, and the anchor 31 is formed inside. With this arrangement, it is possible to form the anchor 31 to have a relatively long and large size. As a result, it is possible to provide a structure that has both the anchors 11 that extend over substantially the total length of the main body portion 15B of the cylinder 15 and the long and large anchors 31 that are bent from one end of the main body portion 15B toward the inside. Consequently, it is possible to achieve a more secure fixing of the segments to the mold resin. The anchors 31 are not the elements that are always necessary, and they may be formed according to the needs.

As described above, the anchors 11 are formed over substantially the total length of the internal peripheral surface of the cylinder 15 that has a plurality of linear hooks 7 at one end. Then, the cylinder 15 is set to the molding die. The mold resin 33 is molded to form the commutator main body 5, and at the same time, the mold resin 33 and the cylinder 15 are integrated together.

After the mold resin 33 and the cylinder 15 have been integrated together, the slits 13 are processed at equal intervals on the external peripheral surface of the cylinder 15, as described above. Therefore, the cylinder 15 is divided into the segments 9. Further, the hooks 7 are bent to the external direction. As a result, the commutator 1 as shown in FIG. 1 is obtained.

As can be understood from the above, it is possible to form the base metal cylinder 15 by processing a round-bar shaped material or a round-pipe shaped material into a hollow cylindrical shape. It is also possible to form the cylinder 15 by processing a plate material into a cylindrical shape. After the base metal has been formed into a cylindrical shape of high precision, the anchors are prepared by cutting. Then, the anchors are embedded into the mold resin 33, and the cylinder 15 is divided into the segments 9, while maintaining the precision of the external shape of the cylinder. Therefore, it is possible to form the commutator 1 in high precision. It is also possible to increase the cutting height of the anchors 11 according to the number of poles of the motor. As a result, it is possible to achieve a more secure integration of the segments into the mold resin.

Figure 9:
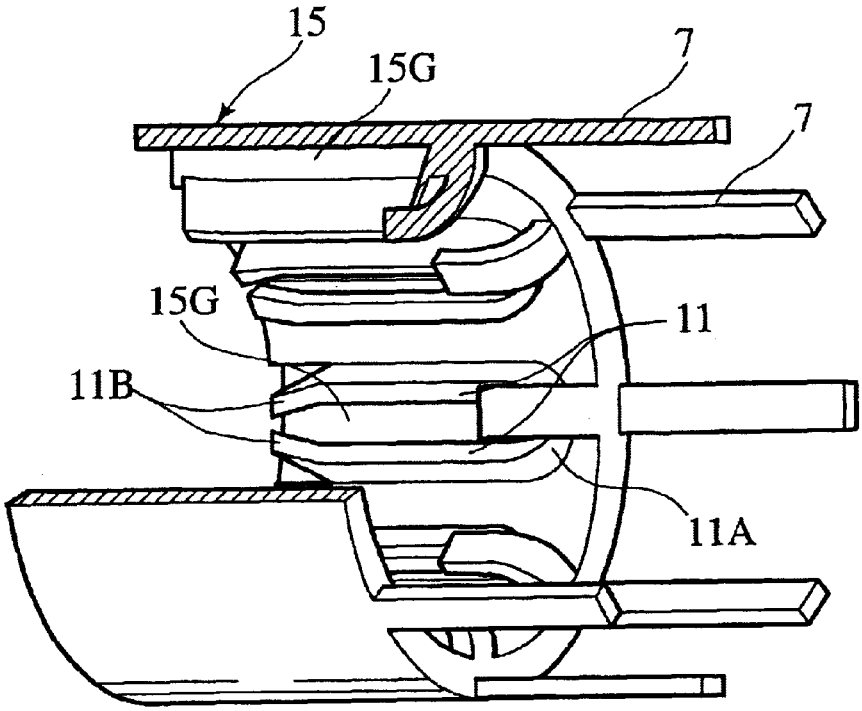
FIG. 9 is a partial sectional view of a cylindrical commutator according to a second embodiment of the present invention.
Figure 10:
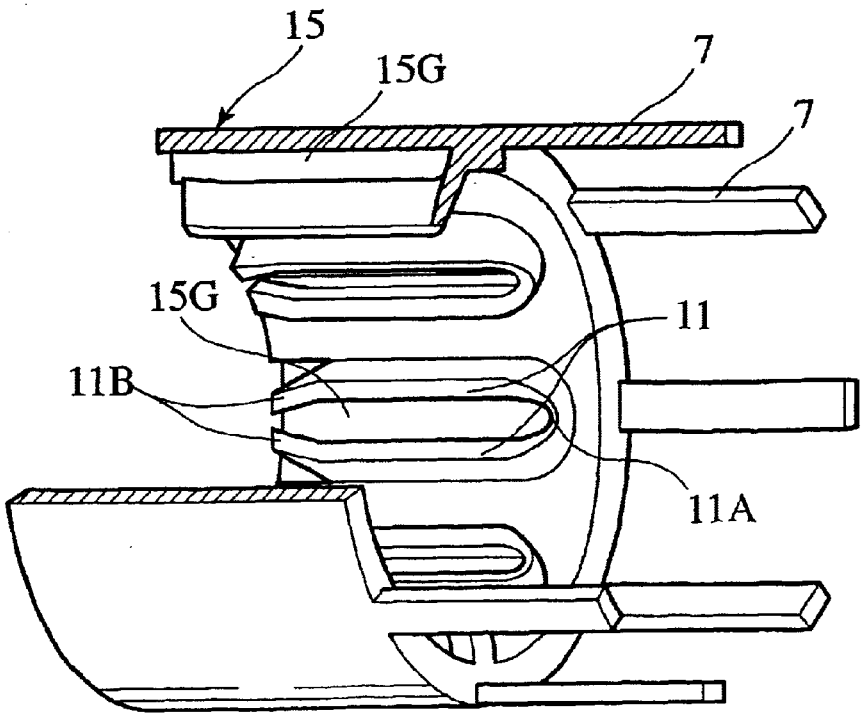
FIG. 10 is a partial sectional view of a cylindrical commutator according to a modified example of the second embodiment of the present invention.

According to the first embodiment as described above, a pair of anchors 11 are formed on both sides of each groove 15G. According to a second embodiment of the present invention shown in FIG. 9 and FIG. 10, a pair of anchors 11 are connected at a connection portion 11A on the edge of each groove 15G near each hook 7. Furthermore, opposite edges of the anchors 11 are slanted so that the slanted portion 11B opens or closes each groove 15G.

The connection portions 11A and the slanted portions 11B of the anchors 11 effectively resist a load which act on the segments 9 in an axial direction after the anchors 11 are embedded in and integrated with the mold resin 33, because the pair of anchors 11 are connected at one end of each groove 15G and the other ends of the anchors 11 are slanted as described above. A load in an axial direction caused from a tension of a coil connected with the hook 7 acts on the segments 9 in case that the motor rotates in high speed, the second embodiment of the present invention makes it possible to manufacture the rigid structure of the cylindrical commutator effective to such an axial directed load.

What is claimed is:

1. A cylindrical commutator comprising:

plurality of mutually insulated segments arranged at equal intervals on the external periphery of a cylindrical surface, each of the segments including a hook for line connection extending from one end thereof, groove formed on an inner surface thereof and a pair of anchors on both sides of the groove extending over substantially the total length of the segment, the pair of anchors being connected with each other at the groove on the side near the hooks and slanted to the groove at the other end of the groove;

a mold resin for fixing the segments in a cylindrical shape, the anchors being embedded therein; and undercuts formed on the mold resin for seperating the segments.

2. A cylindrical commutator according to claim 1, further comprising second anchors, the second anchors being respectively projected inward from proximal ends of the hooks and embedded in the mold resin, wherein the thickness of each hook is divided into two, and the internal side of the divided hook is bent toward the inside so as to be the second anchor.

* * * * *